US005503880A

United States Patent [19]

Matschke

[11] Patent Number: 5,503,880

[45] Date of Patent: Apr. 2, 1996

[54] METHOD AND DEVICE FOR THE ELECTROSTATIC SPRAYING OF COATING MATERIAL

[75] Inventor: Gregg Matschke, Brighton, Mich.

[73] Assignee: Sames S.A., Meylan, France

[21] Appl. No.: 490,921

[22] Filed: Jun. 16, 1995

Related U.S. Application Data

[63] Continuation of Ser. No. 220,676, Mar. 31, 1994, abandoned.

[51] Int. Cl.[6] ..... B05D 1/04

[52] U.S. Cl. ..... 427/475; 361/227; 239/690; 239/708

[58] Field of Search ..... 427/475; 361/226, 361/227, 228; 239/690, 708

[56] References Cited

U.S. PATENT DOCUMENTS

| | | | |
|---|---|---|---|
| 3,637,135 | 1/1972 | Luderer et al. | 239/3 |
| 4,441,656 | 4/1984 | Huber | 239/708 |
| 4,653,696 | 3/1987 | Rath et al. | 239/708 |
| 4,774,102 | 9/1988 | Kieter et al. | 427/26 |
| 4,971,257 | 11/1990 | Birge | 239/708 |
| 5,238,709 | 8/1993 | Wilkie | 427/475 |
| 5,298,277 | 3/1994 | Hirose | 427/8 |
| 5,351,903 | 10/1994 | Mazakas et al. | 239/705 |

FOREIGN PATENT DOCUMENTS

| | | |
|---|---|---|
| 1360743 | 4/1964 | France . |

*Primary Examiner*—Shrive Beck
*Assistant Examiner*—Brian K. Talbot
*Attorney, Agent, or Firm*—Loeb and Loeb

[57] ABSTRACT

A device for the electrostatic spraying of a coating material comprising at least one charge electrode and equipped with an activating trigger connected to the means of supply of the coating material characterized in that it comprises means of adjusting the supply voltage of the said electrode sensitive the to position of the trigger. Thanks to this device, it is possible to control the value of the charge electrode supply voltage during coating as a function of the geometrical configuration of the object.

6 Claims, 5 Drawing Sheets

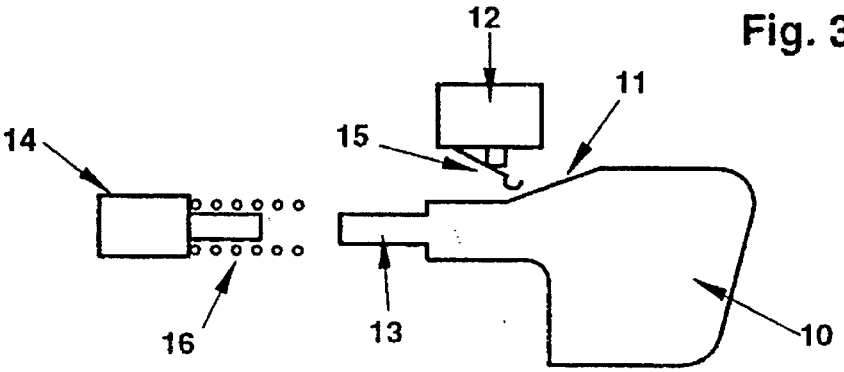
Fig. 3A
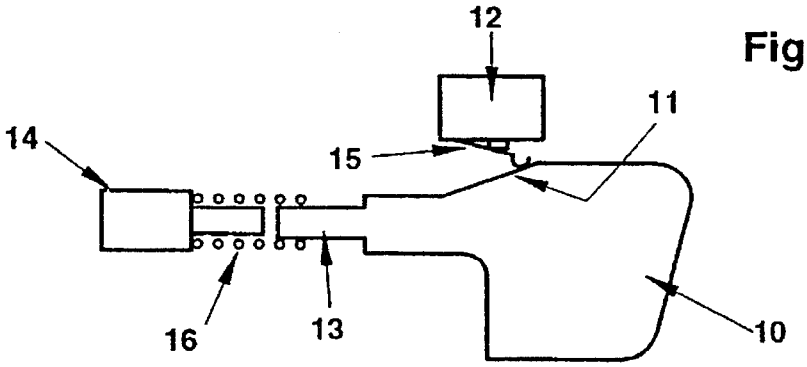
Fig. 3B
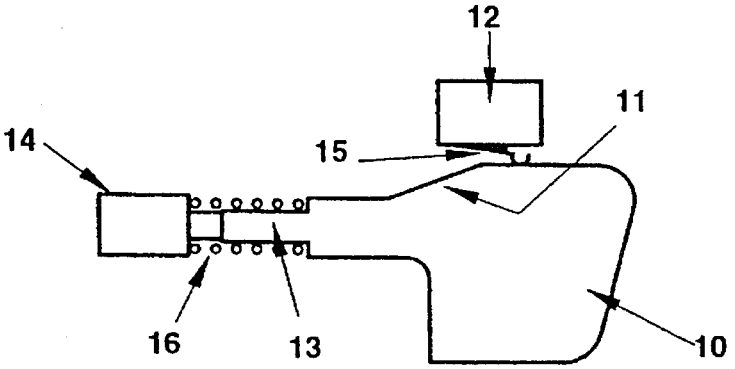
Fig. 3C
Fig. 3

METHOD AND DEVICE FOR THE ELECTROSTATIC SPRAYING OF COATING MATERIAL

This is a continuation of application Ser. No. 08/220,676 filed on Mar. 31, 1994, now abandoned.

BACKGROUND OF THE INVENTION

1. Field of the Invention

The invention concerns an electrostatic method and device for the spraying of liquid or powder and in particular concerns an improvement of the means of electrostatically charging a coating material permitting an optimal and even coating thickness to be obtained whatever the shape of the object being coated.

The invention also permits the transfer efficiency to be improved with respect to that obtained with classical devices thus resulting in a saving in the coating material.

2. Description of the Prior Art

In known devices, the coating material is electrostatically charged by one or several electrodes so as to follow the lines of the electrostatic field between the spraying device and the object to be coated. The charge can be carried out by contact of the material with the electrode or by a Corona discharge of the electrode. In the two cases, the intensity of the electric force undergone by each particle of the coating material, depends on the charge borne by the particle and on the ambient electrostatic field. The latter is a function, among others, of the geometrical configuration of the object to be coated. In fact, if the sharp edge of an object is placed facing the spraying device, the lines of the field all have a tendency to close themselves around this edge. As the particles are guided by the electrostatic field, this leads to an accumulation of the material in this spot while the flat surfaces next to the edge are not coated sufficiently. In the same way, in the case of an object with a cavity, the electrostatic field lines have a tendency to close themselves around the edges of the cavities which tends to prevent the coating material from penetrating into the bottom of the cavity in question.

The invention solves all these problems.

SUMMARY OF THE INVENTION

It concerns a method for electrostatically spraying a coating material characterised in that the value of the supply voltage of at least one electrostatic charge electrode is controlled during the coating of an object as a function of the geometrical configuration of the said object.

Thanks to the method of the invention, one can decrease at the same time the charge of each particle and the intensity of the electrostatic field between the device and the object to be coated as desired, and in particular during the coating of sharp edges or of cavities. This permits the intensity of the electric force undergone by each material particle to be decreased and permits the more efficient use of the aerodynamic forces created by the driving air. Therefore, in the case of the coating of edges or cavities, it is possible to precisely direct the jet of material sprayed mainly with the driving air.

The invention also concerns a manual electrostatic device for the spraying of a coating material comprising at least one charge electrode characterised in that it comprises means to control the value of the supply voltage of the said electrode as a function of the geometrical configuration of the object to be coated.

Finally, the invention concerns an electrostatic device for spraying a coating material comprising at least one charge electrode and equipped with a control trigger connected to the coating material supply means characterised in that it comprises means of adjusting the supply voltage of the said electrode sensitive to the position of the said trigger.

These devices make it possible to put the above method into practise. In fact, thanks to these devices, it is possible to easily control the supply voltage of the electrode and to obtain the desired effect to solve the problems of the previous art.

The invention will be better understood and other advantages of it will appear more clearly in the light of the description which will follow of two modes of realising a device for spraying coating materials conforming to its principle given only as an example and referred to in the drawings annexed, in which:

DETAILED DESCRIPTION OF THE INVENTION

Figure 1:
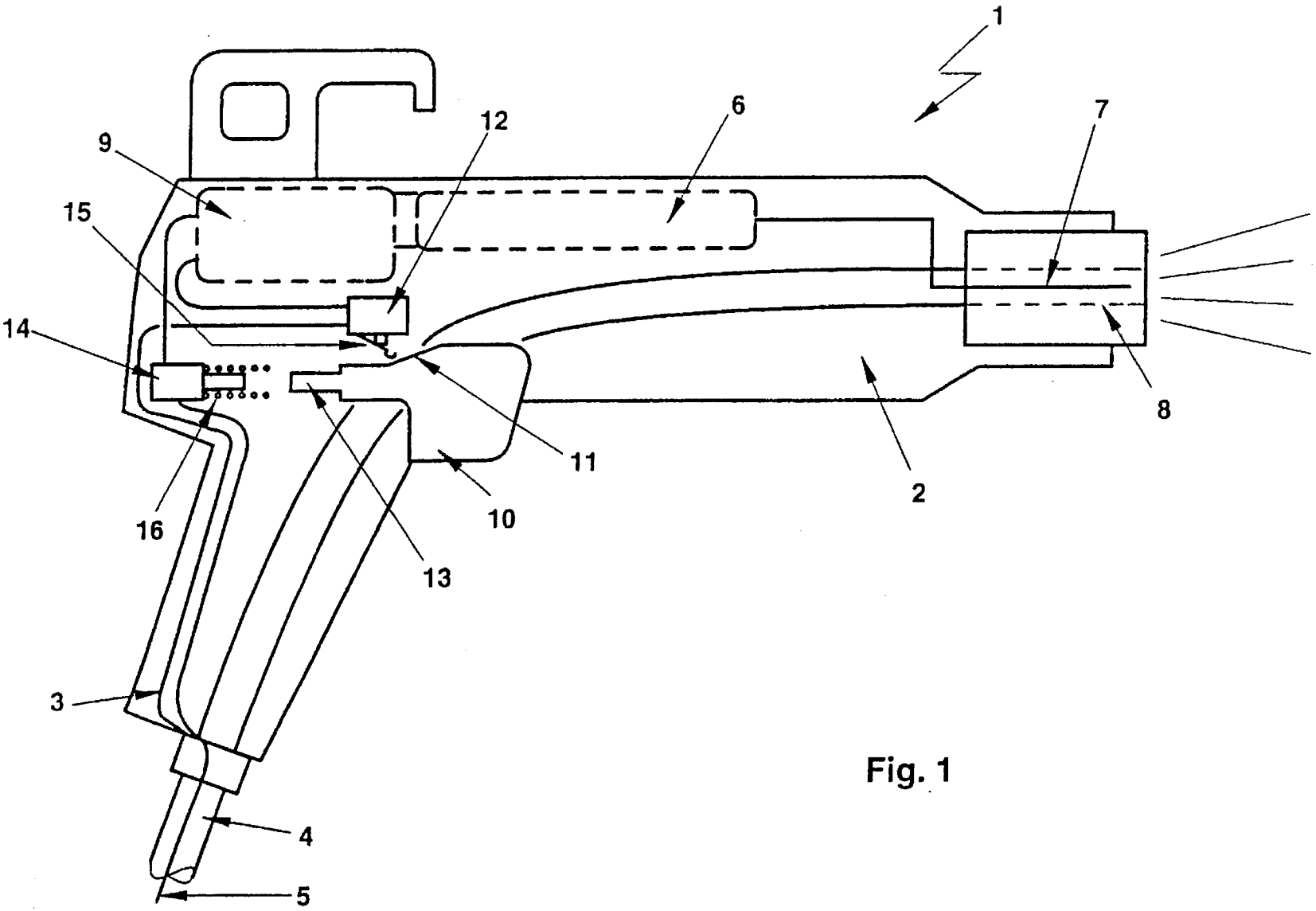
FIG. 1 is a partial schematic view of a section of a manual device according to the invention.

Powder gun 1 shown on the figure is, apart from the high voltage control system, made according to the rules of the art. It comprises a barrel 2 and a handle 3 designed to be taken in the hand by the operator. It is supplied with a mixture of air and powder thanks to a duct 4 in which an electrical cable 5 is lodged for the supply of the high voltage unit 6 integrated into the barrel 2. The high voltage unit 6 is electrically connected to a charge electrode 7 lodged into the spray nozzle 8 located a the end of the duct 4.

Next to the connection area of the handle and the barrel there is a trigger 10 for use by the operator. This trigger carries a first extension 11 capable of operating the turning off a first switch 12 connected to cable 5. The position of the switch is detected in the device's general control system and the pneumatic system for driving the powder and supplying the high voltage of unit 6 are controlled as from this information. The position of the trigger thus permits the sprayer to be activated or not.

The trigger carries a second extension 13 capable of operating a second switch 14. As the end of extension 13 is longitudinally staggered with respect to that of extension 11, the switching closing of switches 12 and 14 takes place in different positions from trigger 10. In the example given, switch 12 is activated at a slight displacement of the trigger while switch 14 is activated at a maximum movement of the trigger.

Two springs 15 and 16 ensure respectively the deactivation of switches 12 and 14. The stiffness constant of springs 15 and 16 might be different, for example,the stiffness constant of spring 16 can be higher than that of spring 15. In the example, spring 15 is made up of the electrical contact blade of switch 12. Thus, switch 12 is activated when there is a slight finger pressure by the operator while switch 14 is activated when there is more pressure exerted by the operator.

As switches 11 and 13 are connected to different supply circuits of the high voltage unit, they can be connected to distinct primary windings of a booster transformer 9.

Figure 2:
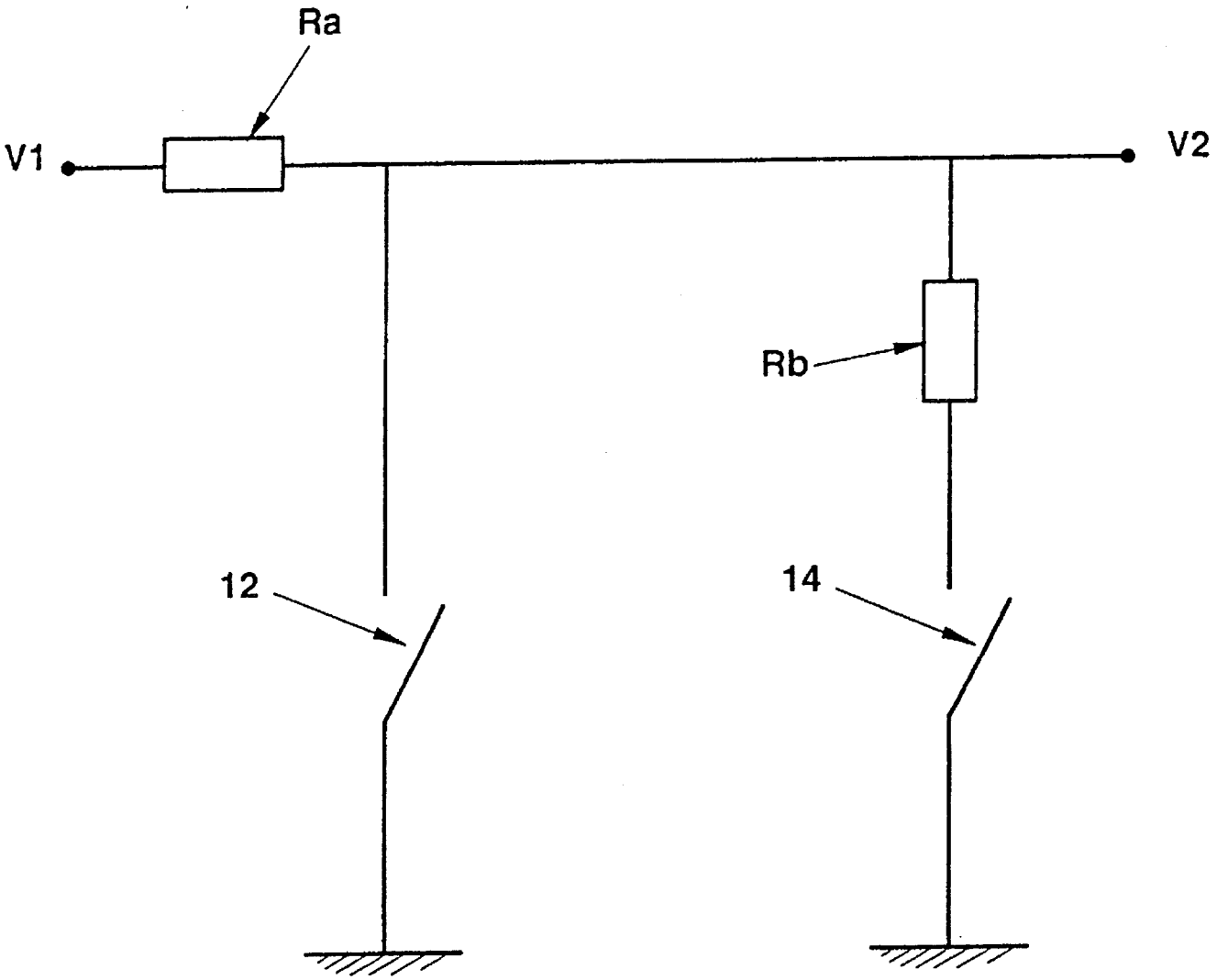
FIG. 2 is an electrical lay-out of the control part of the device in FIG. 1, FIGS. 3A, 3B and 3C are schematic views of the trigger of the device in FIG. 1 in different positions.

On the lay-out drawing of FIG. 2 is represented the continuous power supply V1 and V2 voltage which is delivered at the primary of transformer 9. A bridge dividing the voltage is created thanks to two resistances Ra and Rb. At standstill, switches 12 and 14 are shut, V2 is thus non existant. the power spread into resistance Ra is not important and there is no risk of damaging the equipment. When switches 12 and 14 are activated V2 voltage becomes equal to that of V1 minus the voltage at the terminals of resistance Ra. This corresponds to 100% of the value of the voltage which may be supplied to transformer 9. When switch 14 is not activated, i.e. when shut, V2 voltage drops for the bridge dividing the voltage is activated: A part of the electrical current is spread into resistance Rb. Classically, you have to choose Ra and Rb so that the ratio Rb/(Ra+Rb) equals the ratio required between the fixed voltages at the electrode, for instance 60%.

The value of the maximum voltage is set by the operator at the level of a sprayer control panel which is not shown, which controls the source of voltage at which cable 5 is connected and which delivers voltage V1.

The operating principle to be observed on FIG. 3 is the following:

FIG. 3A represents the position of the trigger at rest, that is to say without pressure being exerted by the operator: no material is supplied to the gun 1 and no high voltage is delivered by unit 6.

FIG. 3B represents the position of the trigger when switch 12 is closed and switch 14 is open: the air/powder mixture is supplied to the gun by circuit 4 and the high voltage to electrode 7 is equal to a determined fraction for example 60% of the value of that which is adjusted by the operator on the general control console of the gun.

FIG. 3C represents the position of the trigger when switch 12 and switch 14 are closed: the air/powder mixture is supplied to the gun by circuit 4 and the high voltage to electrode 7 is equal to 100% of that which is set by the operator on the general control console of the gun.

When the operator coats the parts with large flat surfaces, he exerts strong pressure on trigger, 10 moving it as far as it will go. In this case, the two switches 12 and 14 are both activated, the position of the trigger is that shown on FIG. 3C and the voltage to the electrode is maximum. The coating material is charged at a maximum and is completely submitted to the electrostatic effect. Transfer efficiency is satisfactory because of the use of the electrostatic effect. The material is evenly coated on the surface.

When the operator coats parts with cavities or when the spray jet reaches the edge of a surface, the operator slightly releases the pressure on the trigger so that only switch 12 remains closed, the position of the trigger is that shown in FIG. 3B. The voltage at electrode 7 is then 60% of the maximum voltage and the electrostatic effect decreases considerably. The aerodynamic forces predominate and the operator can direct the spray jet of material at his convenience. However, because some of the electrostatic force is maintained, the transfer efficiency remains acceptable.

Thus the coating material consumed by the devices is permanently deposited by the device in an optimal way on the object, i.e. without accumulating on the edges but right to the bottom of cavities which prevents useless over consumption of the material. Furthermore, the known advantages of coating by electrostatic means, in particular with respect to transfer efficiency, are maintained.

By adapting FIG. 2 electrical drawing or by reversing the working positions of the switches, it is also possible to obtain a maximum voltage at the electrode with the trigger in position of FIG. 31B and a voltage diminished with the trigger of the position of FIG. 3C.

Trigger 10 has been shown as capable of permitting supply to electrode with two values, but the number of values is not limited to two. It suffices to have a number of switches equivalent to switches 12 and 14 and to fit them in the sprayer opposite the trigger's appropriate extensions. In the case of three supply values to electrode 7, it will be advisable to have a voltage to electrode 7 which is lower for the coating of cavities than for the coating of edges.

Figure 4:
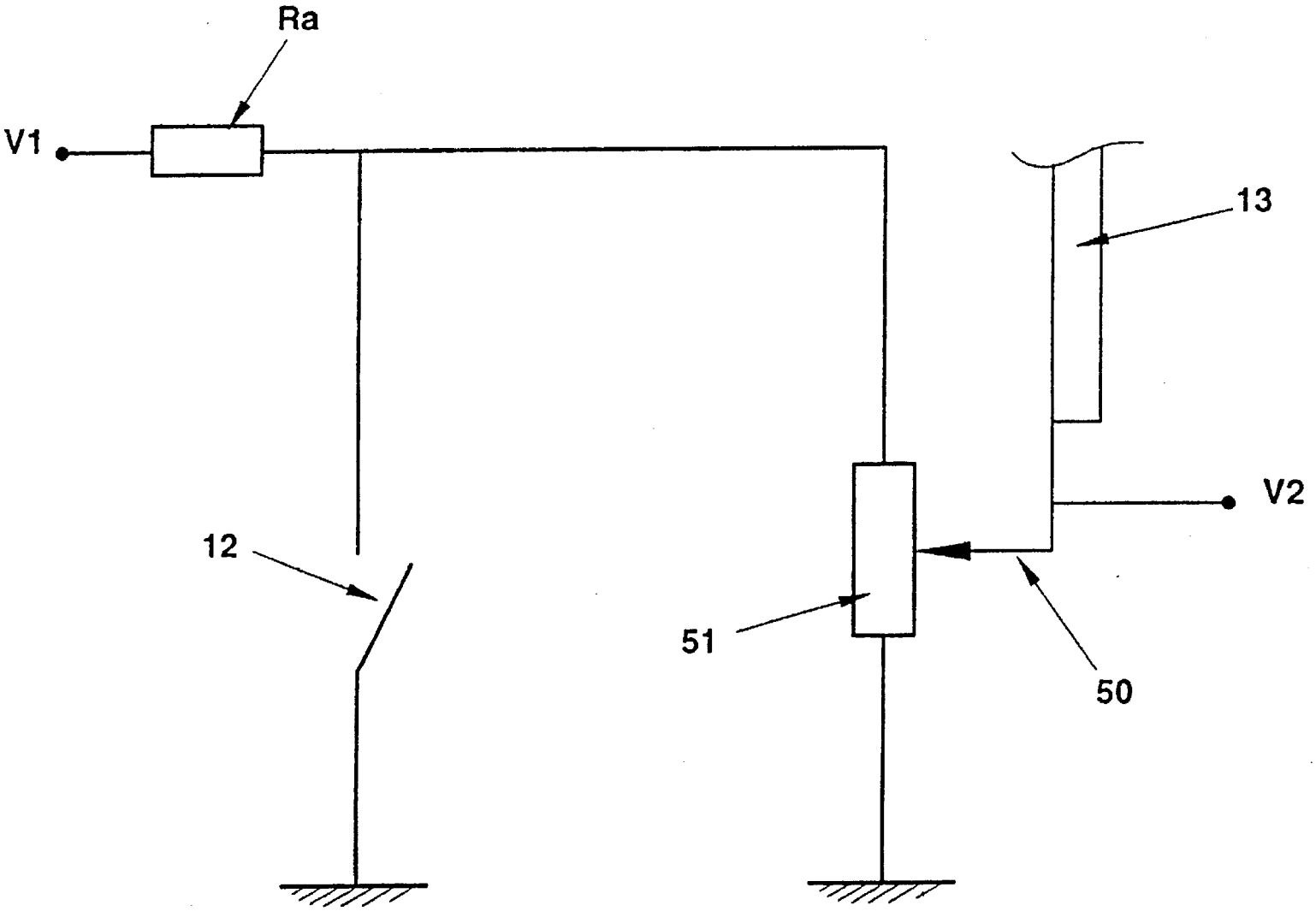
FIG. 4 is a schematic view of a variation of the control part of the device of FIG. 1.

According to the variation shown in FIG. 4, the activating trigger can work progressively, that is to say continuously on a working range. Extension 13 to the trigger is mechanically connected to the contact 50 of a variable potentiometer 51. The other elements, identical to those of FIG. 2, have the same references and the operation is basically the same. Potential V2 depends on the position of the contact 50 on the potentiometer 51 as the Rb/(Ra+Rb) ratio mentioned earlier depends on the active fraction of potentiometer 51. All the values comprised in a defined operating range can thus be selected by the operator which is useful in the case of particularly complex parts. In this later case, it is possible to organize all the control elements for selecting the value of high voltage applied to the electrode 7 onto the gun I itself, possibly including a display: it is no longer necessary to set an external control console.

Though described for a powder gun, the application applies also in the case of a liquid material sprayer. The same activating trigger operating at two levels or with progressive operation as those described above can be used.

Figure 5:
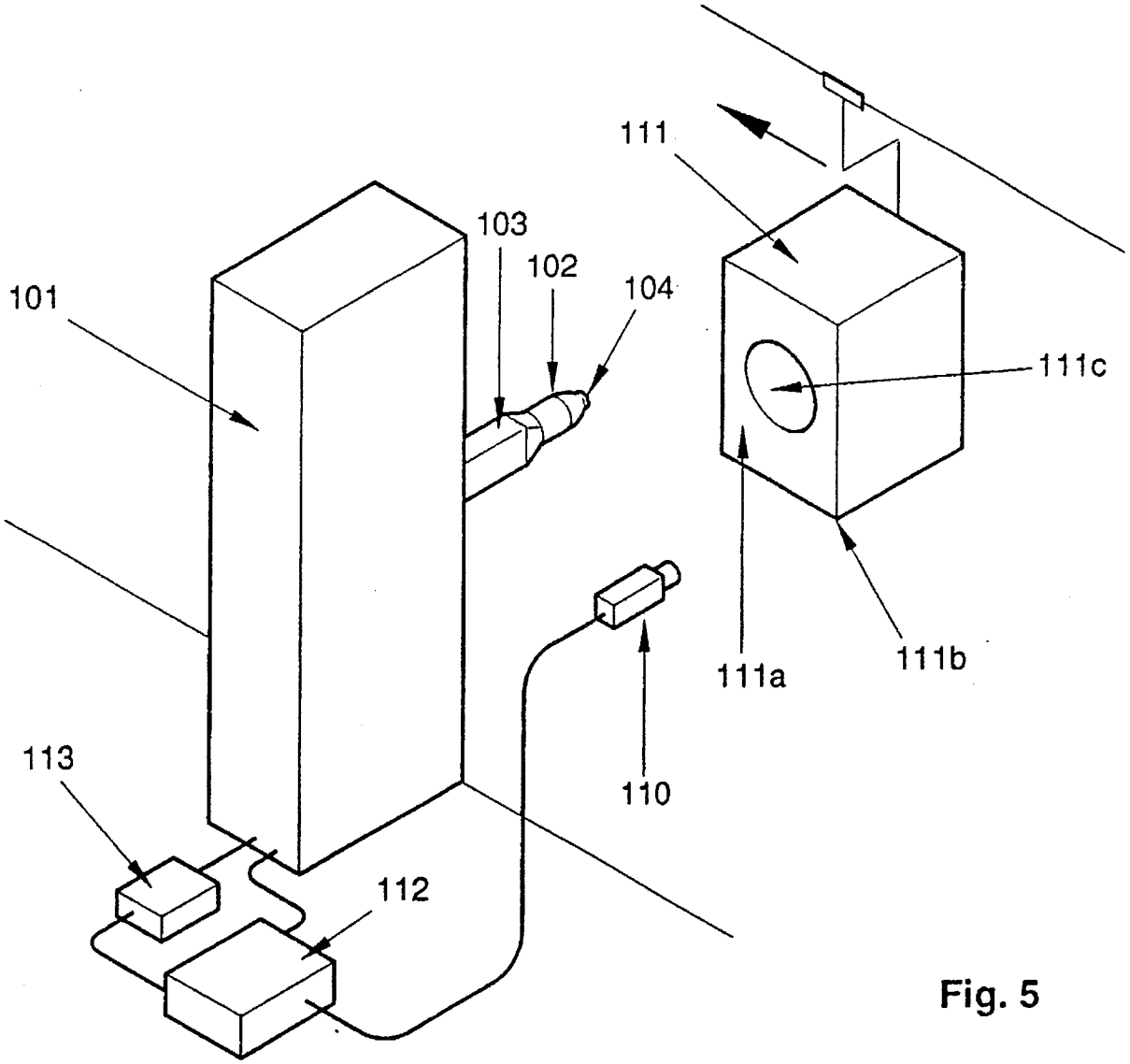
FIG. 5 is a schematic view of an automatic coating system according to the invention.

The installation of FIG. 5, apart from the high voltage control system, is made according to the rules of the art. It comprises an automatic coating machine 101 carrying a liquid paint sprayer 102, rotary for example, fitted at the end of a vertically mobile arm 103. The spray bell 104 can be brought to high voltage by any known means and thus constitutes a charge electrode. A sensor, for example optic, 110 detects the shape of the objects 111, such as for example washing machine bodies transported by a conveyor facing sprayer 102.

Objects 111 can present surfaces which are flat 111*a*, have edges 111*b* and with cavities 111*c*.

Sensor 110 is connected to a control unit 112, which drives machine 101 and a high voltage generator 113, notably as a function, among others, of the signal received from sensor 110. Unit 112 has a memory in which are stocked the geometrical configurations of the objects capable of being treated in the installation.

The operating principle is the following:

As a function of the signal received from sensor 110, unit 112 recognises the objects and adapts the coating parameters such as the positioning of the arm 103, the paint flow supplied to sprayer 103 and the value of the high voltage delivered by generator 113 as a consequence. The value of the high voltage varies during the coating of body 111. Thus it is at a maximum during the coating of a flat surface 111*a* or inside a cavity 111*c*. The accumulation of paint on the edge 111*b* is thus avoided while it is possible to correctly coat the interiors of hollow bodies 111.

There is claimed:

1. A method for electrostatically spraying an electrostatically charged coating material onto an object from a spraying device having a controllable voltage source and an electrode connected to receive a voltage from the voltage source and disposed to impart an electrostatic charge to the coating material as the coating material is being sprayed and to create an electrostatic field between the spraying device and the object, wherein said controllable voltage source comprises a generator for producing an output voltage and a controllable circuit connected between said generator and said electrode and including two on-off switches electrically connected with one another, said step of varying the voltage being carried out by moving said switches with a control means said method comprising varying the voltage applied to the electrode between at least two different values, each of which imparts an electrostatic charge to the coating material, as a function of the geometric configuration of the object, wherein the object has a flat surface portion, a cavity and an edge, and the value of the voltage is maintained at a first value during coating of the flat surface portion, at a second value, lower than the first value, during coating of the edge, and at a third value which is lower than the second value during coating of the cavity.

2. A device for electrostatically spraying an electrostatically charged coating material onto an object, said device comprising: a controllable voltage source; and an electrode connected to receive a voltage from the voltage source and disposed to impart an electrostatic charge to the coating material as the coating material is being sprayed and to create an electrostatic field between the spraying device and the object, wherein said device further comprises control means for varying the voltage applied to the electrode between at least two different values, each of which imparts an electrostatic charge to the coating material, as a function of the geometric configuration of the object, wherein said controllable voltage source comprises a generator for producing an output voltage and a controllable circuit connected between said generator and said electrode and including two on-off switches electrically connected with one another, said switches being mechanically coupled to said control means and being movable by said control means for varying the voltage applied to said electrode.

3. The device according to claim 2 wherein said control means comprise a manually operable control element movable over a path that includes a first working position which causes the voltage applied to said electrode to have a first one of the values, and a second working position which causes the voltage applied to said electrode to have a second one of the values.

4. The device according to claim 3 further comprising coating material supply means for supplying coating material to be sprayed, said supply means being operatively associated with said control element for causing coating material to be sprayed in response to movement of said control element to at least one of the first and second working positions.

5. The device according to claim 4 wherein said control element is a manually operable trigger.

6. The device according to claim 3 wherein said control element is a manually operable trigger.

* * * * *